United States Patent [19]

Alford

[11] 4,408,535

[45] Oct. 11, 1983

[54] EXPLOSIVE CUTTING MEANS

[75] Inventor: Sidney C. Alford, Corsham, England

[73] Assignee: Alflex Limited, Great Britain

[21] Appl. No.: 224,808

[22] Filed: Jan. 13, 1981

[30] Foreign Application Priority Data

Jun. 28, 1980 [GB] United Kingdom ..... 8021273

[51] Int. Cl.[3] ..... F42B 1/00

[52] U.S. Cl. ..... 102/305; 89/1 B; 102/475; 102/701

[58] Field of Search ..... 102/701, 475, 301, 305, 102/306, 307, 309; 89/1 B; 166/55

[56] References Cited

U.S. PATENT DOCUMENTS

| | | | |
|---|---|---|---|
| 2,774,306 | 12/1956 | MacLeod | 102/701 X |
| 3,035,518 | 5/1962 | Coursen | 102/305 |
| 3,076,408 | 2/1963 | Poulter et al. | 102/701 X |
| 3,280,743 | 10/1966 | Reuther | 102/305 |
| 3,374,737 | 3/1968 | Pike | 102/307 X |
| 3,404,600 | 10/1968 | Bilek | 102/701 X |
| 3,435,763 | 4/1969 | Lavine | 102/305 |
| 3,496,868 | 2/1970 | Silvia et al. | 102/305 |

*Primary Examiner*—David H. Brown

*Attorney, Agent, or Firm*—Charles W. Helzer

[57] ABSTRACT

Explosive cutting means comprising explosive material, preferably in flat strip form, which can be arranged in contact with a surface of a target on either side of an intended line of cut and means for so detonating the explosive material that shock waves will be produced in the target material simultaneously on either side of the intended line of cut, which shock waves will travel towards and will coincide substantially at the intended line of cut. The invention also discloses a method of explosive cutting using said means.

26 Claims, 27 Drawing Figures

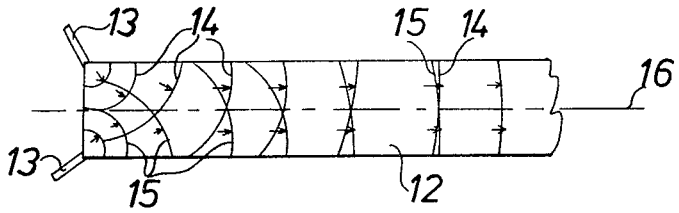
Fig. 4
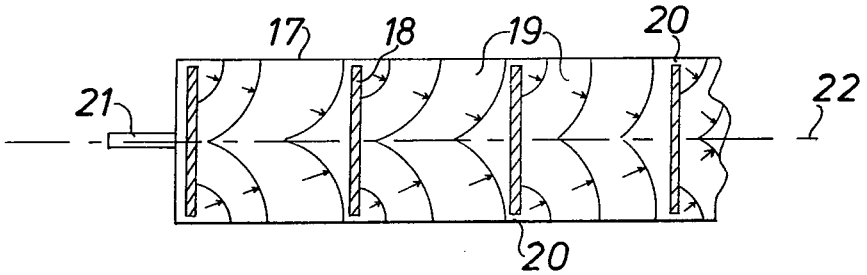
Fig. 5
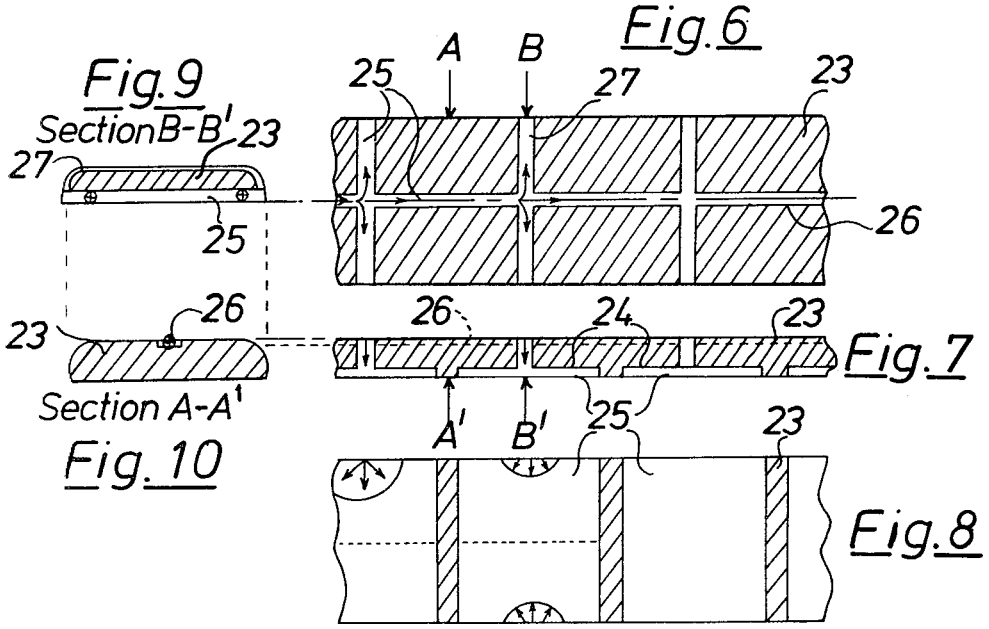

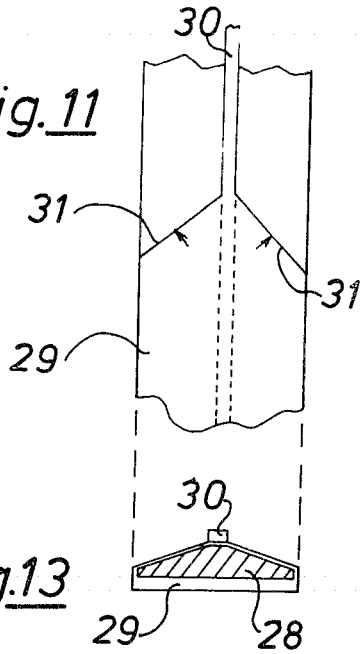
Fig. 11
Fig. 13
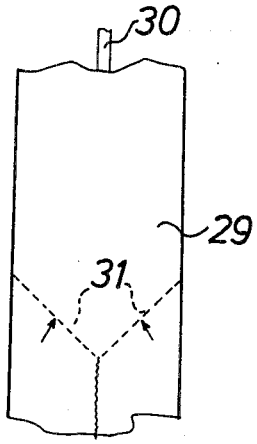
Fig. 12
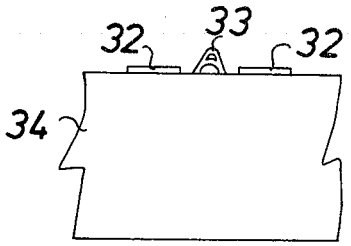
Fig. 14
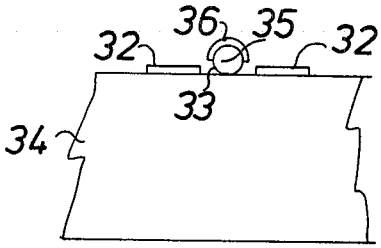
Fig. 15

EXPLOSIVE CUTTING MEANS

This invention relates to explosive cutting means and to a method of cutting using explosive cutting means.

Explosives are used as convenient sources of energy which can be suddenly released in order to perform work on various types of target and various proposals have been made for imparting directionality to this energy release in order to penetrate, distort or otherwise modify a target. Of particular practical importance is the breaking or cutting of metals, e.g., for purposes of demolition, separation of components of an integral structure or destruction of or damage to a target or to a primary target and objects beyond the primary target.

A simple known explosive charge is the so called "plaster charge" which consists of a mass of high explosive in a compact or linear configuration and which is placed in intimate contact with a surface of the target, e.g., the surface of a metal plate. When the charge is detonated a shock wave travels through the metal plate and, provided a medium of lower density than the metal of the plate is in contact with the opposite side of the metal plate, is reflected back from the interface between the metal plate and said medium. In the process the shock wave undergoes a phase inversion so that a compression wave travelling towards said interface is reflected back as a tension or stretching wave, the actual pressure within the plate at a given point being a summation of the compression and the tension waves. Plaster charges of this kind tend to cause "spalling" or "scabbing" of the metal plate, i.e., tend to cause a flake of metal to be torn from the plate on the reverse side thereof to that against which the charge was placed. If sufficient explosive is used the metal plate may be so weakened that residual explosive pressure blows a hole through or severs the plate. Although simple, the use of plaster charges requires relatively large amounts of explosives, gives very ragged cuts, causes distortion of the metal adjacent the cut and may result in the projection of potentially very destructive fragments of metal.

A more precise known method of cutting metal using explosives is by means of shaped charges such as linear cutting charges. A linear cutting charge generally comprises a length of metal which is, e.g., substantially semi-circular or V-shaped in cross-section and an explosive which extends the length of the metal and which must be capable of sustaining detonation with a high velocity of propagation. The length of metal is arranged with its hollow side directed towards and spaced from the target metal to be cut whilst the explosive extends centrally of and in contact with the opposite side of the length of metal. With a semi-circular section length of metal the explosive, when detonated, acts on the length of metal to evert the length of metal and project it as a high velocity metal jet at the target, the target thus being severed if the charge is sufficiently powerful. In the case of a V-section length of metal, the pressure exerted by the explosive, when detonated, serves to drive the two limbs of the V-section length of metal towards one another at high velocity so that they collide. As a result of the collision of the said two limbs a small part of each of the limbs is stripped off and is projected at the target as an extremely fast-moving blade-like jet which is capable of producing a very deep and narrow cut in a metal target for a given amount of explosive.

Shaped charges generally produce deeper cuts with less explosive and cause less damage to the target than plaster charges. They do, however, suffer from disadvantages. If the explosive charge is not matched to the metal and thickness of the target so as to just cut the target then the extremely fast moving metal jets produced by the shaped charge can cause considerable damage beyond the actual target. A second disadvantage is that the shaped charge has to be spaced from the target metal by a distance, usually about one or two charge widths, sufficient to allow the aforesaid jets to develop. For cutting underwater it is essential to exclude water from the space between the cutting charge and the target which complicates the setting of the charge, even in shallow water. In deep water the setting of the charge can become even more complicated since it sometimes becomes necessary to pressurize the said space using compressed air or other gas in order to compensate for the hydraulic pressure of the water. A third disadvantage with shaped charges is that those used for producing deep cuts of a centimeter or more are invariably rigid and cannot be bent to follow the contour of, e.g., a target having a curved surface or to produce a cut other than that for which the charge was designed, e.g., a non-rectilinear cut in the case of a rectilinear cutting charge. Thus, for example, in the petroleum industry it is sometimes required to cut metal pipes of, say, 915 mm. in diameter and having a wall thickness of say 25.4 mm., and to do this it is necessary to specially manufacture a pair of semicircular shaped charges and to mount them around and in spaced relation to the pipe using complicated and expensive mounting means.

The present invention has as its object to provide an explosive cutting means, and a method of cutting using same, which will enable some or all of the disadvantages of the known plaster or shaped charges to be overcome.

The present invention provides explosive cutting means, the means comprising explosive material adapted to be arranged in contact with a surface of a target to be cut on either side of the intended line of cut and means for so detonating the explosive material that shock waves will be produced in the target material simultaneously on either side of the intended line of cut, which shock waves will travel towards and will coincide substantially at the intended line of cut.

The present invention also provides a method of cutting using explosive material, the method comprising arranging explosive material in contact with a surface of a target to be cut on either side of the intended line of cut and so detonating the explosive material that shock waves will be produced in the target material simultaneously on either side of the intended line of cut, which shock waves will travel towards and will coincide substantially at the intended line of cut.

The explosive cutting means of the present invention may comprise separate bodies e.g., strips, of explosive material which can be arranged on either side of the intended line of cut and which can be detonated simultaneously.

However, according to a preferred embodiment of the present invention the explosive cutting means is in the form of a single strip which can be applied to a surface of a target to be cut along the intended line of cut so as to extend laterally on either side of the intended line of cut and which comprises explosive material and means for so detonating the explosive material that detonation proceeds from the opposed lateral margins of the strip towards the intended line of cut.

With the explosive cutting means and method of the present invention the opposed shock waves induced in the target material by the simultaneous detonation of explosive material on either side of the intended line of cut produce in the target material initial compression waves which coincide first substantially at the intended line of cut on the one surface of the target material with which the explosive was in contact and which pass down through the target material along the intended line of cut before being reflected back from the opposite surface of the target material as phase-inverted tension waves. Thus each point along the intended line of cut is submitted first to the summated pressure of the coincident compression waves, to sudden relief of this pressure as the coincident compression waves pass on and then to the summated tension of the phase-inverted tension waves. It is believed that it is the destructive effect of this sequence of compression, relaxation and tension which induces fracture of the target material substantially along the intended line of cut from said opposite surface of the target material back towards said one surface thereof.

Moreover it has been noted that if an explosive material in contact with a surface of a target is detonated simultaneously from opposite sides thereof a narrow cut can be produced in the underlying one surface of the target material with which the explosive material was in contact, which cut coincides with the point at which the two detonation fronts collide and which extends normal to the direction of travel of the two detonation fronts. It is believed that this narrow transverse cut is produced by the summation of the pressures associated with the different detonation fronts. This further phenomenon is utilized in the preferred embodiment of the present invention referred to above so as to produce in the target material a cut in said one surface thereof which extends substantially along the intended line of cut and fracture of the target material substantially along the intended line of cut from said opposite surface of the target material towards said cut.

The invention will be more particularly described with reference to the accompanying diagrammatic drawings, in which:

FIG. 1 is a diagram illustrating the compression waves and reflected tension waves produced in a metal plate when an explosive charge is detonated in contact with a surface of the metal plate, FIG. 2 is a diagram illustrating how the compression waves and tension waves produced in a metal plate by the simultaneous detonation of two spaced explosive charges in contact with a surface of the metal plate coincide to produce maximum pressure and maximum tension intermediate the two explosive charges, FIGS. 3A and 3B are diagrammatic views illustrating the effect produced in a metal plate when a strip of explosive material is detonated simultaneously from both ends, FIG. 4 is a diagram illustrating the progression of two detonation fronts along a strip of explosive material when detonated simultaneously from opposed sides of one end of the strip, FIG. 5 is a diagrammatic plan view of one embodiment of explosive cutting means according to the present invention, FIG. 6 is a top plan view of another embodiment of explosive cutting means according to the present invention, FIG. 7 is a side view of the cutting means of FIG. 6, FIG. 8 is an underneath plan view of the cutting means of FIG. 6, and FIGS. 9 and 10 are sections on the lines B—B' and A—A' respectively of FIGS. 6 and 7.

FIG. 11 is a top plan view of another embodiment of explosive cutting means according to the present invention, FIG. 12 is an underneath plan view of the means of FIG. 11, and FIG. 13 is a section through the cutting means of FIG. 11.

FIG. 14 is a diagrammatic end elevation of a further embodiment of cutting means according to the invention, and FIG. 15 is a diagrammatic end elevation illustrating a modification of the embodiment of FIG. 14.

Figure 16:
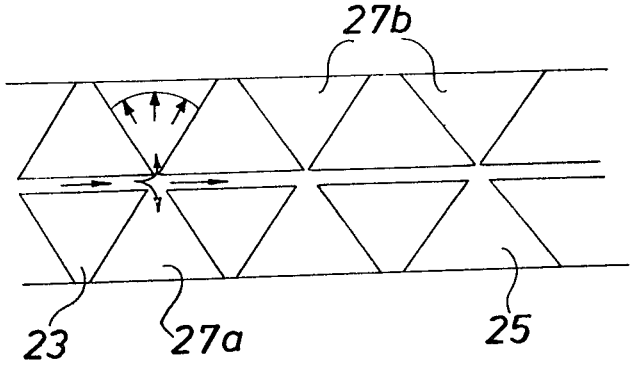
Figure 17:
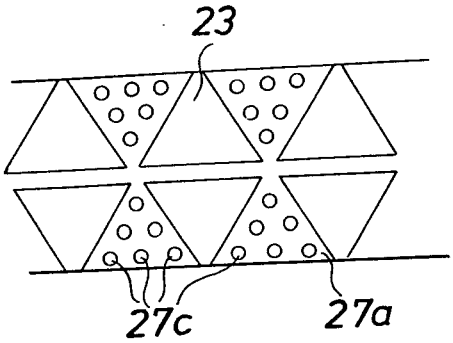
Figure 18:
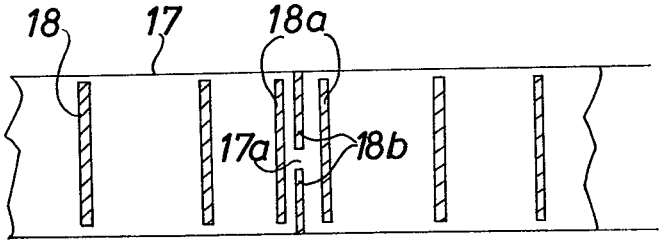
Figure 19:
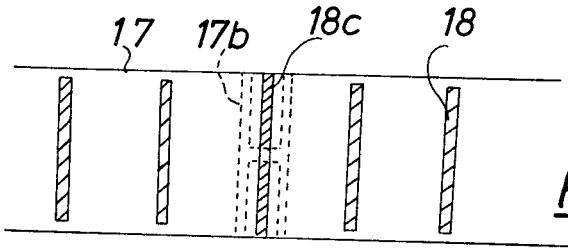
Figure 20:
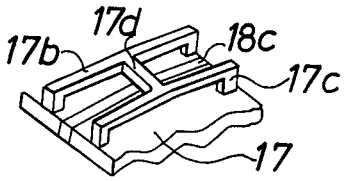
Figure 21:
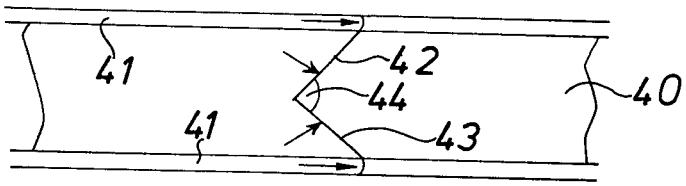
Figure 22:
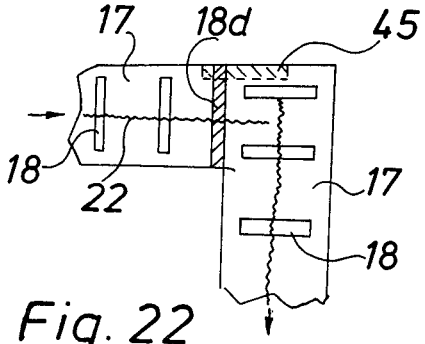
Figure 23:
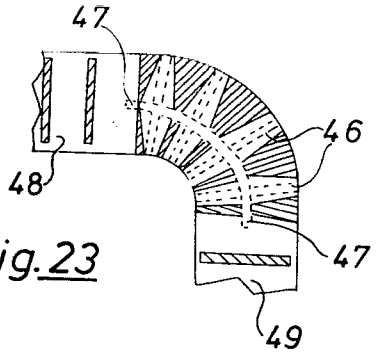
Figure 24:
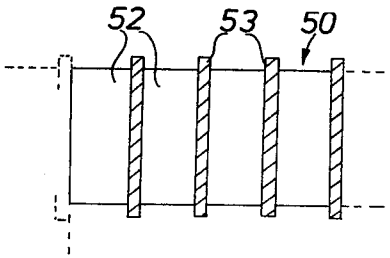
Figure 25:
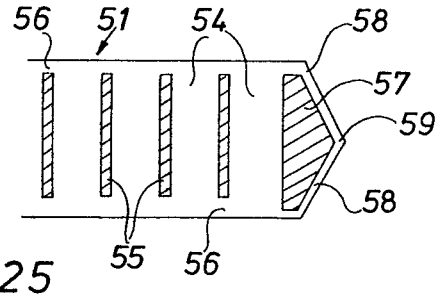
Figure 26:
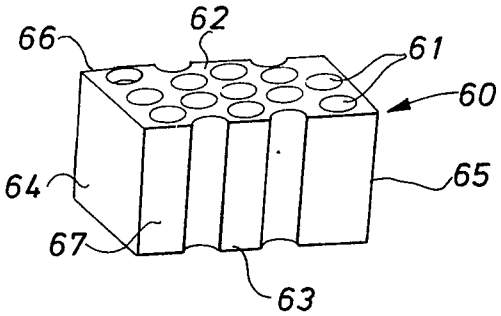
Figure 27:
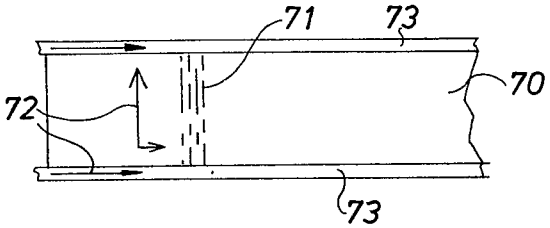

FIG. 16 diagramatically shows a modified form of the embodiment of the invention shown in FIGS. 6–10;

FIG. 17 shows a variation of the arrangement shown in FIG. 6 to include control elements;

FIG. 18 shows a modification to the embodiment of the invention shown in FIG. 5;

FIG. 19 and FIG. 20 show a variation of the arrangement of FIG. 18;

FIG. 21 shows another embodiment of the invention wherein explosive materials having two different volocities of propagation of detonation are employed;

FIG. 22 and FIG. 23 illustrate angled strips of explosive constructed according to the invention;

FIGS. 24 and 25 illustrate a composite strip of explosive according to the invention; and FIG. 26 and FIG. 27 illustrate still another embodiment of the invention providing controlled propagation of detonation along two dimensional axis of a strip of explosive material and uncontrolled propagation along the third orthogonal axis of the strip.

Figure 1:
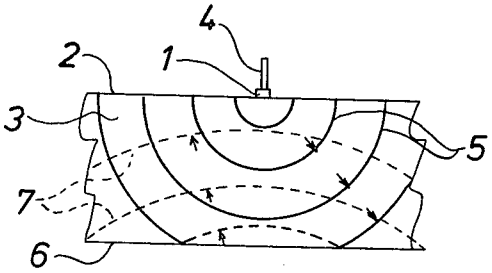

Referring to FIG. 1 of the drawings it will be seen that if a narrow strip of explosive 1 in contact with a surface 2 of a metal plate 3 is detonated by means of a detonator 4 shock waves will be produced in the metal plate 3 at each point along the strip of explosive 1 and that these shock waves will emanate from the point of explosive attack as expanding compression waves 5 (shown in full line) and will be reflected back from the opposite surface 6 of the plate 3 as expanding phase-inverted tension waves 7 (shown in broken line).

Figure 2:
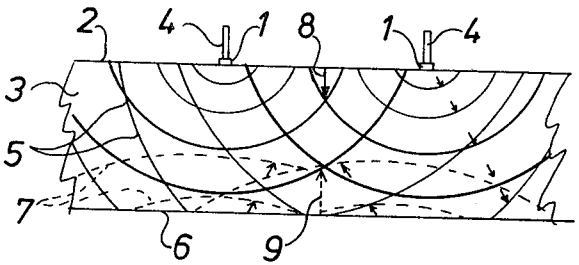

Referring now to FIG. 2, in which like parts have been given like reference numerals, it will be seen that when two narrow strips of explosive 1 in contact with the surface 2 of the metal plate 3 are detonated, the compression waves 5 and tension waves 7 so produced coincide and produce along a line extending through the metal plate substantially midway between the two strips of explosive a region of summated maximum pressure which travels from the surface 2 to the surface 6 as indicated by the arrow 8 and a region of summated maximum tension which is reflected back from the surface 6 to the surface 2 as indicated by the arrow 9. Thus each point along the said line will be subjected to the destructive effects of summated pressure, relaxation and summated tension which, if the explosive charges are sufficient, will induce fracture of the metal plate 3 along said line from the surface 6 to the surface 2.

Figure 3A:
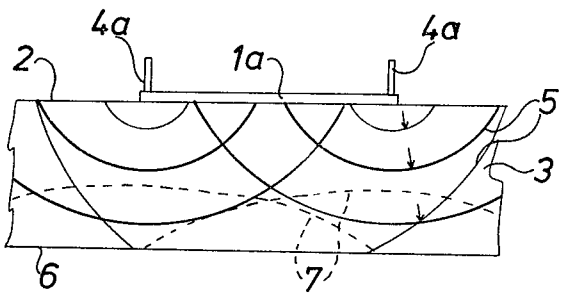
Figure 3B:
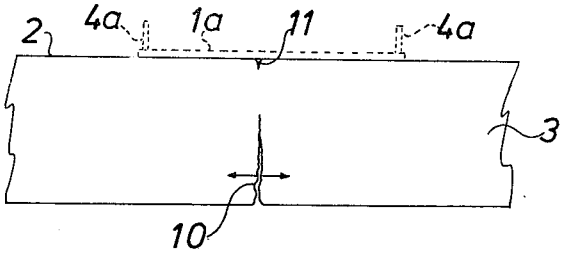

The same effect can be obtained as shown in FIG. 3A using a single strip of explosive 1*a* in contact with the surface 2 of a metal plate 3 and detonated simultaneously from both ends by means of detonators 4*a* to produce fracture of the metal plate 3 from the surface 6 thereof as indicated at 10 in FIG. 3B. However, when such a single strip of explosive 1*a* is used, a second phenomenon occurs in that a narrow cut 11 extending transverse to the strip of explosive 1*a* will be produced in the surface 2 of the metal plate 3 where the two detonation fronts collide. If the explosive 1*a* is properly chosen then a fracture 10 and a cut 11 can be induced in the metal plate 3 which will combine to sever the metal plate 3.

A strip of explosive 1*a* as illustrated in FIG. 3 will, of course, only produce a fracture 10 and a cut 11 of a length substantially equal to the width of the strip of explosive. Clearly it would be advantageous if explosive cutting means could be produced which was in strip form and which could be detonated from opposite lateral side margins thereof. Such a strip-like cutting means could be of any required length and could be laid along a required line of cut to sever the metal plate along the required line of cut. As will be seen from FIG. 4, if a strip of explosive 12 is detonated simultaneously from opposite sides of one end thereof by means of detonators 13 the two detonation fronts indicated by lines 14, 15 respectively will initially progress both inwardly towards the intended line of cut 16 and longitudinally of the strip 12 but as detonation proceeds along the length of the strip of explosive 12 the tendency will be for the direction of progression of the detonation fronts to become progressively less inwards and progressively more longitudinal until it is wholly longitudinal. This tendency can be overcome by suitable design of the explosive cutting means.

In the embodiment of the present invention illustrated in FIG. 5, explosive cutting means is provided which comprises a flat strip 17 of explosive material having delay elements 18 of non-explosive material e.g., of metal or plastics, or air or gas filling a space incorporated therein. The delay elements 18 divide the strip 17 into areas 19 which are completely separated from one another except at the ends of the elements 18 where they are connected by bridge portions 20. A single detonator 21 is provided at one end of the strip 17 for detonating the explosive material. It will thus be seen that as detonation proceeds along the length of the strip 17 it will be periodically interrupted by the delay elements 18 and begun afresh from the lateral side margins of the strip by virtue of the bridge portions 20, so ensuring the propagation of two detonation fronts each of which progresses both inwardly towards the intended line of cut 22 and longitudinally of the strip 17.

In the embodiment of FIGS. 6 to 10 the explosive cutting means of the present invention comprises a flat carrier strip 23 of non-explosive material, e.g., a suitable flexible plastics material, having recesses 24 in a lower surface thereof which extend across the full width of the strip 23 and which contain explosive material 25. A longitudinally extending channel 26 is provided centrally of the upper surface of the strip 23 and is connected to opposite sides of each of the recesses 24 by means of lateral branch channels 27. The channels 26 and 27 also contain explosive material 25, or a suitable fuse material, so that when the material in the channel 26 is detonated or ignited from one end of the strip 23 detonation will proceed by way of the channels 26 and 27 to the lateral side margins of the explosive material in each of the recesses 24 in turn, whereby detonation of the explosive material in each of the recesses 24 will proceed from the lateral side margins thereof towards the longitudinal centre of the strip 23.

The embodiment of FIGS. 11 to 13 is also in unitary strip form and comprises a carrier or buffer strip 28 of inert, non-explosive, material, e.g., a suitable flexible plastics material, which is completely enclosed in explosive material 29 constituting a main charge. The explosive material 29 is applied as a thin layer over the upper and side surfaces of the strip 28 and as a much thicker layer over the lower surface of the strip 28. A longitudinally extending strip 30 of initiating explosive material is provided centrally of the upper surface of the strip 28 for detonating the explosive material 29. The initiating explosive material of the strip 30 is so chosen relative to the main charge explosive material 29 as to have a significantly higher detonation velocity than the main charge explosive material, so ensuring that longitudinal propagation in the main charge explosive material 29 will be slower than the propagation in the initiating strip 30 and that the detonation fronts 31 of the main charge explosive material 29 will be directed both inwardly towards the longitudinal axis of the lower surface of the strip 28 and longitudinally thereof.

For use underwater or in any situation where the ingress of moisture is likely to be a problem, the explosive cutting means, and particularly a unitary strip-form cutting means of the kind shown in FIG. 5, FIGS. 6 to 10 or FIGS. 11 to 13, can be sheathed in a suitable waterproof or water-resistant material, e.g., a suitable plastics material. The unitary strip-form cutting means of the present invention can be produced in continuous lengths and can be such that it can be cut to size as required. Moreover in contrast to the known linear cutting charges, the unitary strip-form cutting means of the present invention can be relatively flexible so that it can readily be positioned in contact with a curved surface of a target, e.g., the outer surface of a large diameter cylindrical metal pipe.

As described hereinbefore with reference to FIGS. 3A and 3B, the advantage of using explosive cutting means of unitary strip form is that a superficial fracture or cut 11 is produced in the upper surface of the target material which tends to direct the main fracture 10. An alternative to this is to use explosive cutting means comprising two parallel strips of explosive material arranged one on either side of the intended line of cut and to use a third strip of explosive material extending along the intended line of cut and designed specifically to produce a narrow directing cut in the upper surface of the target material.

Thus, as shown in FIGS. 14 and 15, two strips of explosive material 32 may be provided which are arranged on either side of the intended line of cut and a third strip 33 provided which extends along the intended line of cut and which is designed to produce a superficial cut in that surface of the target 34 with which it is in contact. In the embodiment shown in FIG. 14 the strip 33 comprises a conventional lead-sheathed linear cutting charge whilst in the embodiment of FIG. 15 it comprises a hollow tube 35 having a layer of explosive material 36 on the outer surface thereof. With the explosive material 36 provided on the outer surface of the hollow tube 35 the ends of the tube can be crimped or otherwise sealed so as to exclude water from the tube and so provide an air space which will allow collapse of the wall of the tube. In either of the embodiments of FIGS. 14 and 15 the detonation velocity of the strip 33 must not be lower than that of the strips 32, unless only a short cut is to be made, since if detonation of the strips 32 proceeds at a significantly greater rate than that of the strip 33 the efficacy of the strip 33 will be impaired.

The embodiment of FIG. 16 is an improvement on the embodiment of FIGS. 6 to 10 and like reference numerals have been used to indicate like parts. In the embodiment of FIG. 16 the laterally extending channels 27 have been replaced by substantially triangular recesses 27*a* which contain the explosive or fuse material 25. The base 27*b* of each recess 27*a* extends the length of the adjacent lateral side edge of its corresponding recess 24 (FIGS. 7 and 8) so that detonation will be initiated along the whole of the length of each lateral side edge of each recess 24 and not just from the centres of said lateral side edges as in the embodiment of FIGS. 6 to 10.

With the triangular recesses 27*a* of the FIG. 16 embodiment, the distance between the apex of each triangular recess and the midpoint of the base is shorter than the distance between the apex and the ends of the base with the result that when explosive material 25 in a recess 27*a* is detonated the detonation front tends to be arcuate so that detonation of the explosive material contained in the recesses 24 does not take place substantially simultaneously at all points along each lateral side edge thereof. This tendency can be overcome or mitigated as shown in FIG. 17 by providing spaced barriers 27*c* which are so arranged that the shortest path between the apex of each triangular recess 27*a* and each point along the base of the triangular recess is substantially the same. The barriers 27*c* may comprise simply apertures in the explosive material filling the recesses 27*a* or may comprise bodies of inert material, e.g., projecting upwardly from the bottoms of the recesses and formed integrally with the carrier strip 23. The explosive cutting means of FIG. 17 is particularly useful in situations where the explosive cutting means at one or both ends thereof overlaps a target to be cut as it reduces spalling of the target where it is overlapped by said one or both ends of the cutting means.

The fracture capability of charges of the kind described above in relation to FIGS. 6 to 10 or FIGS. 16 or 17 can be improved by forming all or part of the carrier strip 23 from a high density material such as lead, although the fracture tends to be more irregular.

With explosive cutting means of the kind illustrated in FIG. 5 the production of a cut along the line 22, which conicides with the longitudinal axis of the explosive cutting means, depends upon the two detonation fronts progressing at the same velocity. There is, however, a tendency for one detonation front to progress at a faster rate than the other so that the actual line of cut becomes displaced from the intended line of cut towards the slower detonation front by a distance proportional to the amount by which the slower detonation front lags behind the faster detonation front, this tendency becoming the more exaggerated the longer the explosive cutting means. To mitigate this tendency the explosive cutting means of FIG. 5 can be provided at intervals along the length thereof with means for arresting the longitudinal propogation of the two detonation fronts and for re-initiating the two detonation fronts simultaneously from the two lateral side margins of the explosive cutting means.

Said arresting and re-initiating means may be as shown in FIG. 18 and may comprise a pair of fairly closely spaced delay elements 18*a* similar to the delay elements 18 and, intermediate the delay elements 18*a*, a pair of laterally aligned delay elements 18*b* which are spaced from one another by a medial band 17*a* of explosive material. It will thus be seen that the delay elements 18*a* and 18*b* are so arranged that they will arrest the longitudinal propogation of the two detonation fronts and define an H-shaped bridge of explosive material 17 which includes the band 17*a* and which will re-initiate the two detonation fronts simultaneously from both lateral margins of the explosive cutting means irrespective of the longitudinal direction in which the detonation fronts are progressing.

A similar effect to that obtained by the arresting and re-initiating means of FIG. 18 can be obtained with the means shown in FIGS. 19 and 20. The means shown in FIGS. 19 and 20 comprises an arresting element 18*c* which extends over the full width of the explosive cutting means and is adapted to completely arrest longitudinal progression of the two detonation fronts and an H-shaped bridge 17*b* of explosive material. The bridge 17*b* of explosive material is raised on four legs 17*c* of explosive material above the explosive material 17 and is arranged with the centre connecting bar 17*d* thereof bridging the arresting element 18*c* and with a leg 17*c* on each side of the arresting element 18*c* at each lateral side margin of the explosive cutting means.

FIG. 21 shows a further embodiment of explosive cutting means according to the present invention which comprises a strip of explosive material 40 having attached to each of its longitudinal side edges a narrow strip of explosive material 41 chosen so as to have a significantly higher detonation velocity than the main charge strip of explosive material 40. Thus when the strips of explosive material 41 are detonated from one end thereof the detonation will proceed longitudinally thereof at a faster rate than the detonation of the main charge and will produce in the main charge two detonation fronts 42,43 which progress both inwardly towards one another and longitudinally, the angle 44 between the two fronts 42,43 being determined by the relative detonation velocities of the two explosive materials 40 and 41. The greater the difference between the detonation velocities of the two explosive materials the smaller will be the angle 44.

It will readily be apparent that if it is desired to make a cut in, e.g., a target steel plate, which is curved or angled in the plane of the target plate then special provisions will need to be made since if a linear cutting means such as is described above were to be laid around a curve so that the cutting means itself was curved laterally then the outside of the curve would be longer than the inside of the curve and this would seriously affect the symmetry of progression of the two detonation fronts. Two solutions to this problem are shown in FIGS. 22 and 23.

In the embodiment shown in FIG. 22, two linear explosive cutting means of the kind shown in FIG. 5 are arranged with an end of one abutting a side margin of the other at a required angle and with the interposition therebetween of a delay element 18*d*. Assuming that detonation is progressing in the direction longitudinally of the cutting means indicated by the arrows, an explosive bridge 45 is provided which makes contact with the explosive material 17 of the two explosive cutting means only at its ends and which will carry detonation over from the first explosive cutting means and re-initiate it medially of the adjacent end of the second explosive cutting means.

The embodiment shown in FIG. 23 is a specially produced corner piece which is similar to the embodiment of FIGS. 6 to 10 but wherein the recesses 24 in the lower surface thereof are replaced by recesses 46 which are so arranged and dimensioned that there will be sufficiently less explosive material in the recesses 46 on the outside of the curve as compared with the recess 46 on the inside of the curve that detonation will proceed symmetrically around the curve. The corner piece of FIG. 23 can be used with linear explosive cutting means of any of the kinds described above and may be provided with an explosive bridge 47 at each end thereof with is similar to the bridge 45 of the FIG. 22 embodiment and which will carry detonation over from a first linear cutting means 48 to the corner piece and then from the corner piece to a second linear cutting means 49.

FIGS. 24 and 25 illustrate a specific example of a linear explosive cutting means according to the present invention which is based on the embodiment of FIG. 5. The example of FIGS. 24 and 25 may be used for cutting, for example, mild steel plate of about 32 mm. in thickness. The linear cutting means of FIGS. 24 and 25 comprises a first strip 50 illustrated in FIG. 24 and a second strip 51 illustrated in FIG. 25 which are adapted to be superimposed one upon the other in a manner to be described. The first strip 50 is 3 mm. in thickness and comprises bands 52 of RDX-based sheet explosive SX2, each band being 60 mm. long and 20 mm. wide and the bands being separated by transverse rubber strips 53 which are 6 mm. wide and at least 60 mm. long. The second strip 51 is also 3 mm. in thickness and comprises bands 54 of the same RDX-based sheet explosive and of the same size as the bands 52, the bands 54 being partially separated by transverse rubber strips 55 which are 6 mm. wide but only 50 mm. long so that a continuous band of explosive 56 which is 5 mm. wide extends along each of the lateral side margins of the strip 51. At one or both ends thereof the strip 51 is tapered to a point and has inset therein a generally triangular rubber insert 57 so as to provide two initiating strips 58 which diverge laterally outwards from a central initiation point 59. The second strip 51 is superimposed upon the first strip 50 so that the bands 54 of explosive are aligned with the bands 52 and the rubber strips 55 are aligned with the rubber strips 53. The rubber strips 55 may be secured, e.g., adhered, to the rubber strips 53 or may be formed integrally therewith.

The purpose of the delay elements in embodiments such as that shown in FIG. 5 is to prevent or retard longitudinal propagation of the detonation fronts without interfering with transverse propagation of the two fronts inwardly towards one another. An alternative method of achieving the same result is possible.

In connection with FIG. 17 it was explained how spaced barriers can be provided in a sheet of explosive material which serve to reduce the apparent velocity of propagation of a detonation front by extending the actual path which at least some increments of the front are caused to follow. Following on from this and turning now to FIG. 26, it will readily be appreciated that if a block 60 of explosive material were to have an array of apertures or other suitable barrier means 61 extending therethrough from the face 62 thereof to the face 63 and such barrier means 61 were to be suitably arranged, then the detonation velocity from the face 64 of the block 60 to the face 65 or from the face 66 to the face 67 would be retarded by the barrier means 61 whilst the detonation velocity from the face 62 to the face 63 of the block 60 would be unaffected by the barrier means 61 and would in consequence be higher than as between the other faces. This same principal can be used to good effect to produce an anisotropic explosive sheet or strip material comprising an explosive and a substantially parallel array of filaments or fibers of a suitable barrier material which lie in the plane of the sheet or strip and are so dispersed in the explosive that detonation in one direction in the plane of the sheet or strip will be retarded whilst detonation in the plane of the sheet or strip in a direction perpendicular thereto will be unimpeded. Thus such an anisotropic explosive sheet or strip material will exhibit maximum and minimum detonation velocities in directions perpendicular to one another in the plane of the sheet or strip. Suitable barrier materials for said filaments or fibres include natural or synthetic rubber, suitable plastics materials and metals of high density such as lead. An embodiment of a linear cutting means using such an anisotropic explosive sheet or strip material is illustrated in FIG. 27.

Referring to FIG. 27 it will be seen that the cutting means illustrated therein comprises a central strip of anisotropic explosive material 70 having filaments 71 of a suitable barrier material so dispersed therein that detonation longitudinally of the strip 70 will be retarded whilst detonation laterally of the strip 70 will be unimpeded and therefore of a higher velocity as indicated by the arrows 72 the relative lengths of which are indicative of the relative rate at which detonation proceeds in the direction indicated by each particular arrow. On either side of the central strip 70 are strips of explosive material 73 which do not incorporate any filaments 71 and in which in consequence longitudinal detonation is unimpeded.

The linear cutting means of the present invention may be provided with any suitable means whereby they can be secured to a target to be cut. Thus the linear cutting means may have a suitable contact adhesive, if necessary covered with a suitable release paper, on that surface thereof which is to be in contact with the target. Where said surface includes areas of explosive material and areas of inert material then said adhesive may be applied only to the inert areas so as to avoid any possibility of the adhesive attenuating the effectiveness of the explosive material. Alternatively, if the cutting means is for attachment to ferrous targets, the cutting means may be adapted to attach to ferrous targets magnetically. To this end discrete magnets may be incorporated in the cutting means or, where that surface of the cutting means which is to be applied to the target comprises areas of explosive material and areas of inert material, at least some of said areas of inert material may be magnetic as by forming them from rubber or plastics material having magnetic particles, e.g., or barium ferrite, incorporated therein.

Other possibilities for maintaining the explosive cutting means of the present invention in contact with a surface of a target to be cut, e.g., the external surface of a large diameter pipe, include such devices as an inflatable sleeve or cuff which can be placed over the cutting means and then inflated or an elastically resilient band or the like which can be expanded over the target and the explosive cutting means.

Whilst in the embodiments of the invention illustrated in the drawings the explosive material used is in solid or plastic form it will be understood that by suitable design of the explosive cutting means powder or liquid explosive materials can be used. Thus, for example, the explosive cutting means could comprise a flat carrier strip similar to the strip 23 of FIGS. 6 to 10 but having chambers therein instead of recesses and passages therein instead of channels, the chambers and passages being filled with powder or liquid explosive material.

What is claimed is:

1. Explosive cutting means comprising explosive material adapted to be arranged in contact with a surface of a target to be cut on either side of an intended line of cut and means for so detonating the explosive material simultaneously on either side of the intended line of cut that shock waves produced thereby will travel towards and will coincide substantially at the intended line of cut, said explosive material comprising at least one strip filled with explosive material that can be applied to said surface of the target to be cut along the intended line of cut so as to extend laterally on either side of the intended line of cut, and means for so controlling the detonation of the strip of explosive material that detonation proceeds simultaneously from the opposed lateral margins of the strip towards the intended line of cut and from at least one end of said strip whereby said controlling means causes detonation of the explosive material to proceed both longitudinally along the strip and laterally inwardly of the strip and the shock waves produced thereby will coincide substantially at the intended line of cut with the line of coincidence of the shock waves moving longitudinally along said intended line of cut.

2. Explosive cutting means according to claim 1, comprising a central anisotropically explosive strip consisting of explosive material and laterally oriented filaments of non-explosive barrier material dispersed therein so that detonation longitudinally of the strip will be retarded whilst detonation laterally of the strip will be unimpeded and on either side of said central strip a strip of explosive material free from said filaments.

3. Explosive cutting means according to claim 1, comprising two strips of explosive material which can be arranged on either side of the intended line of cut so as to extend parallel thereto, a third strip of explosive material which can be arranged along the intended line of cut, and means for detonating all three strips of explosive material simultaneously.

4. Explosive cutting means according to claim 1, comprising first and second said strips arranged at an angle to one another with an end of one abutting a side margin of the other at the adjacent end thereof, means for arresting detonation at said end of said one strip, and bridge means of explosive material for carrying detonation over said arresting means from said one strip to the other strip so that detonation of the other strip will be initiated simultaneously from both lateral side margins of said adjacent end thereof.

5. Explosive cutting means according to claim 1, comprising a main charge of explosive material which is in strip form, said controlling means comprising at least one initiating strip of explosive material extending longitudinally of said main charge and having a higher detonation velocity than the main charge of explosive material.

6. Explosive cutting means according to claim 5, comprising a buffer strip of inert material coated on the whole of its outside surface with said main charge explosive material and a said initiating strip of explosive material extending along the longitudinal centreline of that surface of the strip opposite the surface which is to be placed against a target to be cut.

7. Explosive cutting means according to claim 5, wherein a said initiating strip of explosive material extends along each of the lateral side edges of the strip-form main charge of explosive material.

8. Explosive cutting means according to claim 1, wherein said controlling means comprises delay elements of inert non-explosive material.

9. Explosive cutting means according to claim 8, comprising a strip of explosive material and a plurality of delay elements which extend laterally of the strip of explosive material and are spaced from one another so as to divide the strip of explosive material lengthwise into sections which are separated from one another except at the lateral margins of the strip.

10. Explosive cutting means according to claim 9, wherein at least at one place along the length of said strip means is provided for arresting longitudinal propagation of detonation and for re-initiating detonation on the other side of the arresting means simultaneously from the two lateral margins of the strip.

11. Explosive cutting means according to claim 10, wherein said arresting and re-initiating means comprise a first pair of delay elements which are spaced from one another longitudinally of the strip and each of which extends from the longitudinal centre of the strip laterally outwards towards and terminates short of the lateral side margins of the strip and a second pair of delay elements intermediate said first pair of delay elements and each of which extends from a lateral side margin of the strip inwardly to terminate short of the other, whereby said first and second pairs of delay elements will arrest longitudinal propagation of detonation and define an H-shaped bridge of explosive material which will re-initiate detonation simultaneously from the lateral side margins of the strip irrespective of the longitudinal direction of propagation.

12. Explosive cutting means according to claim 10, wherein said arresting said re-initiating means comprises an arresting element of non-explosive material which extends laterally across the full width of the strip of explosive material and a substantially H-shaped bridge of explosive material having a downturned leg of explosive material at each of the four free ends thereof, said bridge being arranged with the centre connecting bar thereof bridging said arresting element and with a said leg on each side of the arresting element at each lateral side margin of the strip.

13. Explosive cutting means according to claim 1, comprising a flat strip of non-explosive material, recesses in a surface of said strip which is adapted to be placed against a target to be cut, said recesses containing explosive material and extending the full width of the strip, the explosive material in said recesses being separated lengthwise of the strip by narrow bands of said non-explosive material, an initiating strip of explosive material extending along the longitudinal centreline of the opposed surface of the said strip, and laterally extending bodies of explosive material connecting said initiating strip with the opposed lateral side margins of the explosive material in each of said recesses.

14. Explosive cutting means according to claim 13, wherein said strip has a channel in said opposed surface thereof which extends along the longitudinal centreline thereof and which contains said initiating strip of explosive material.

15. Explosive cutting means according to claim 13, wherein said laterally extending bodies of explosive material are strips of explosive material contained in laterally extending channels in said opposed surface.

16. Explosive cutting means according to claim 13, said flat strip following a curved path which is in the plane containing the flat strip and said laterally extending bodies of explosive material being such as to compensate for said curved path and initiate detonation of the explosive material in each of said recesses substantially simultaneously from both lateral side margins thereof.

17. Explosive cutting means according to claim 13, wherein said laterally extending bodies of explosive material are substantially triangular in shape so that they diverge laterally outwards from said initiating strip.

18. Explosive cutting means according to claim 17, wherein the base of each said triangular body of explosive material coincides with and is substantially the same length as a lateral side margin of the explosive contained in a said recess.

19. Explosive cutting means according to claim 18, wherein said triangular bodies of explosive material have spaced non-explosive barriers incorporated therein which are so arranged that the shortest explosive path between the initiating strip and each point along the base of each triangle is substantially the same.

20. Explosive cutting means according to claim 19, wherein said non-explosive barriers comprise apertures in the triangular bodies of explosive material.

21. A method of cutting using explosive material, the method comprising arranging explosive material in at least one strip in contact with a surface of a target to be cut on either side of an intended line of cut and so detonating the strip of explosive material that shock waves will be produced in the target material simultaneously on either side of the intended line of cut and will travel towards and coincide substantially at the intended line of cut after initiating detonation of the strip of explosive material from at least one end, and so controlling detonation of the strip of explosive material that said detonation proceeds both longitudinally and laterally inwardly of the strip and the shock waves produced thereby will coincide substantially at the intended line of cut with the line of coincidence of the shock waves moving longitudinally along said intended line of cut.

22. A method according to claim 21 which comprises arranging strips of explosive material on either side of and parallel to the intended line of cut and simultaneously detonating said strips of explosive material.

23. A method according to claim 22, which comprises arranging a third strip of explosive material along the intended line of cut and detonating said third strip simultaneously with the other two.

24. A method according to claim 25, which comprises arranging a single strip of explosive material along the intended line of cut so as to extend laterally on either side thereof and so controlling the detonation of the explosive material that detonation proceeds at least partially from the opposed lateral margins of the strip means towards the intended line of cut.

25. A method according to claim 24, which comprises adhesively securing said strip means to said surface of a target to be cut.

26. A method according to claim 24, which comprises magnetically securing said strip means to a said surface of a ferrous target to be cut.

* * * * *